US010059096B2

(12) United States Patent
Fukuda et al.

(10) Patent No.: US 10,059,096 B2
(45) Date of Patent: Aug. 28, 2018

(54) LIQUID DISCHARGING APPARATUS, CONTROL METHOD OF LIQUID DISCHARGING APPARATUS, DEVICE DRIVER, AND PRINTING SYSTEM

(71) Applicant: SEIKO EPSON CORPORATION, Tokyo (JP)

(72) Inventors: Masako Fukuda, Shiojiri (JP); Tomohiro Sayama, Matsumoto (JP); Hironori Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/548,504

(22) PCT Filed: Mar. 15, 2016

(86) PCT No.: PCT/JP2016/001479
§ 371 (c)(1),
(2) Date: Aug. 3, 2017

(87) PCT Pub. No.: WO2016/152093
PCT Pub. Date: Sep. 29, 2016

(65) Prior Publication Data

US 2018/0001619 A1 Jan. 4, 2018

(30) Foreign Application Priority Data

Mar. 24, 2015 (JP) ..... 2015-060551

(51) Int. Cl.
*B41J 2/045* (2006.01)

(52) U.S. Cl.
CPC ..... *B41J 2/0451* (2013.01); *B41J 2/04541* (2013.01); *B41J 2/04581* (2013.01); *B41J 2/04586* (2013.01); *B41J 2/04588* (2013.01)

(58) Field of Classification Search
CPC .. B41J 2/0451; B41J 2/04586; B41J 2/04541; B41J 2/04588; B41J 2/04581
See application file for complete search history.

(56) References Cited

U.S. PATENT DOCUMENTS

2013/0141484 A1* 6/2013 Kasai ..... B41J 2/125 347/14
2013/0222477 A1 8/2013 Fukuda et al.

FOREIGN PATENT DOCUMENTS

JP 2011212932 A * 10/2011
JP 2015-009519 1/2013
(Continued)

OTHER PUBLICATIONS

International Search Report dated May 24, 2016 for PCT/JP2016/001479.

*Primary Examiner* — Sharon A Polk
(74) *Attorney, Agent, or Firm* — Workman Nydegger

(57) ABSTRACT

A control method of a liquid discharging apparatus includes: a discharge inspection step of inspecting discharge abnormality of a nozzle by a discharge inspection mechanism; a remaining oscillation inspection step of inspecting oscillation of the ink inside a pressure chamber by a oscillation inspection circuit when the discharge abnormality is detected; a first correction step of performing correction which corresponds to the attachment of the resin inside the pressure chamber with respect to the driving pulse when abnormality is detected in oscillation; a re-discharge inspection step of inspecting the discharge abnormality of the nozzle after the first correction step; and a second correction step of performing the correction which corresponds to the attachment of the resin inside the nozzle with respect to the driving pulse when the abnormality is not detected in the
(Continued)

oscillation in the oscillation inspection step or when the discharge abnormality is detected in the re-discharge inspection step.

7 Claims, 5 Drawing Sheets

(56) References Cited

FOREIGN PATENT DOCUMENTS

| | | | | |
|---|---|---|---|---|
| JP | 2013-176900 | | | 9/2013 |
| JP | 2013237208 | A | * | 11/2013 |
| JP | 2014-094449 | | | 5/2014 |
| JP | 2014172303 | A | * | 9/2014 |

* cited by examiner

[Fig. 1]
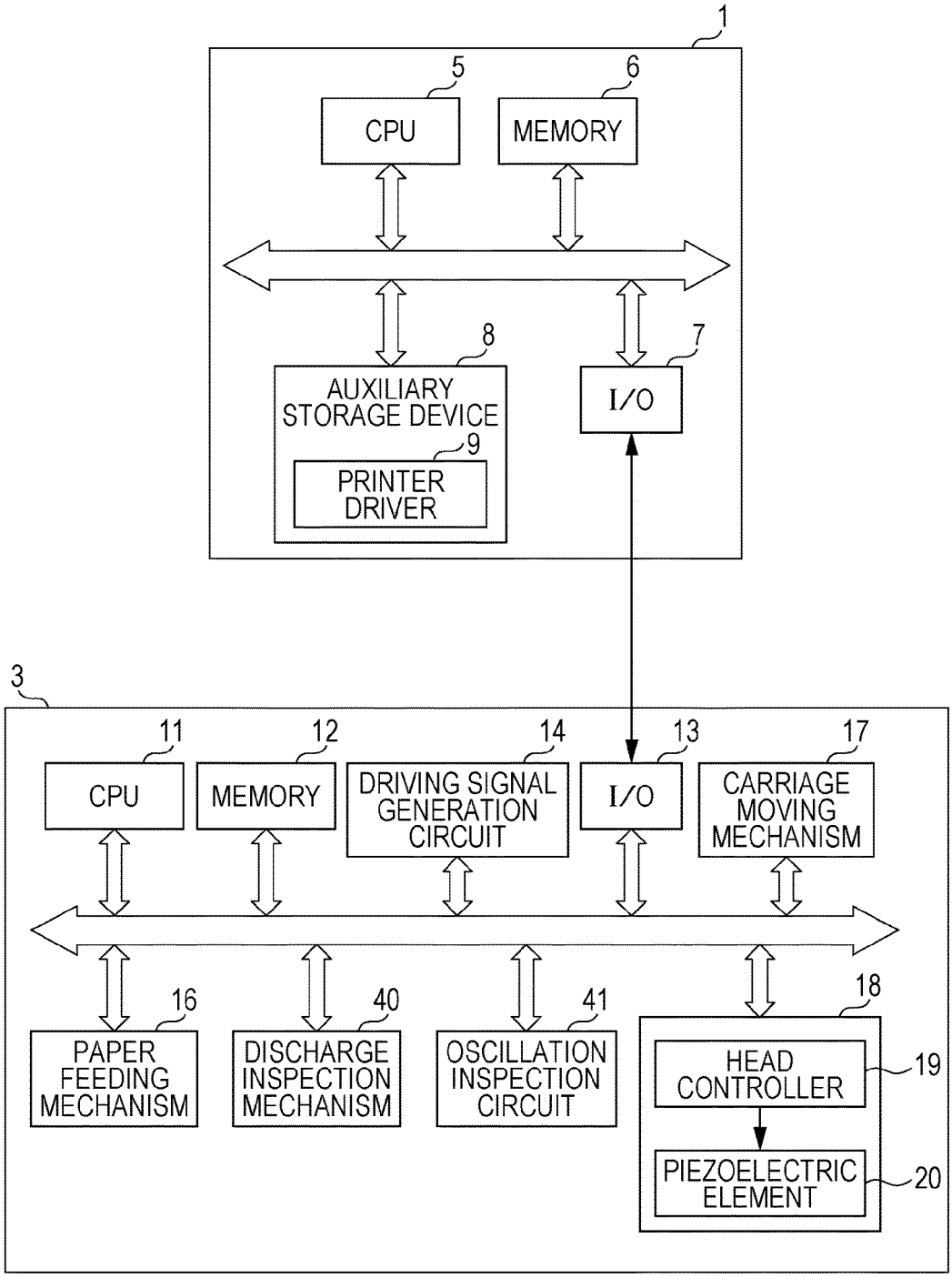

[Fig. 2]
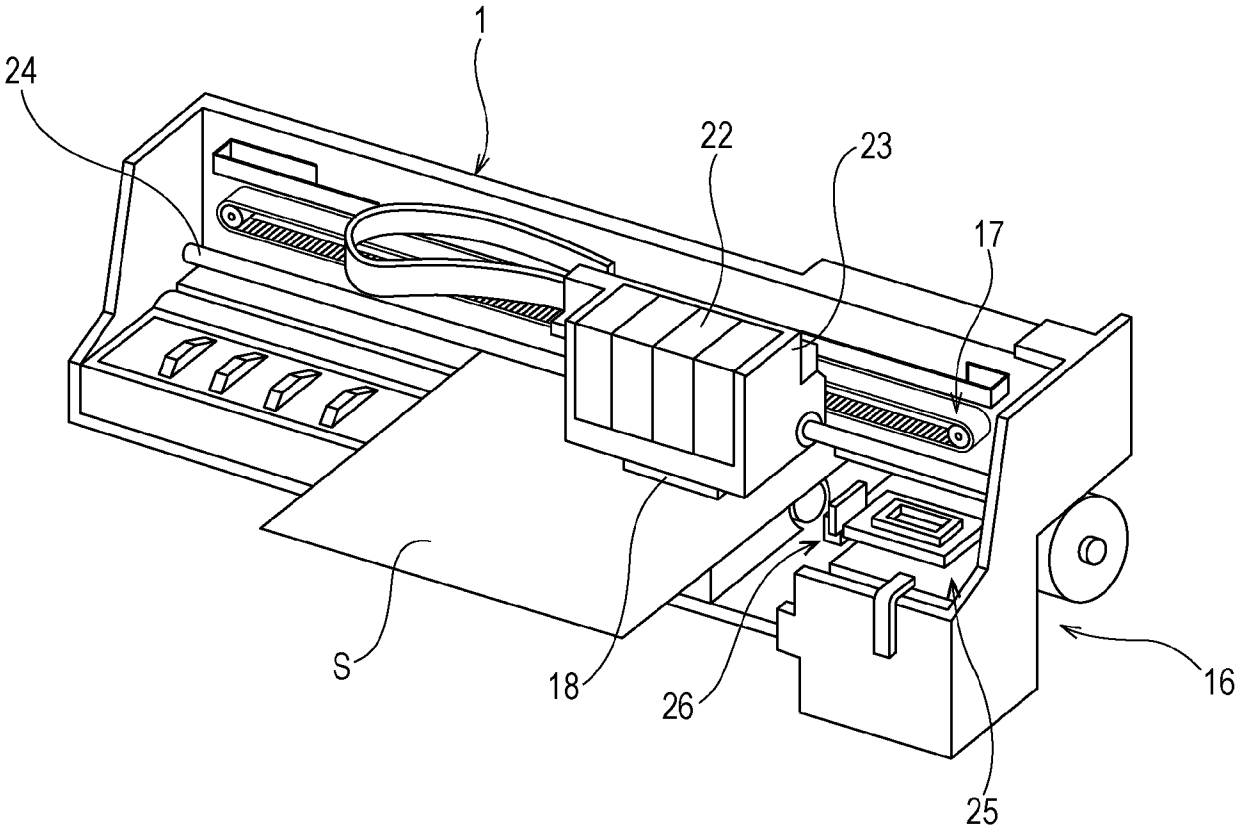

[Fig. 3]
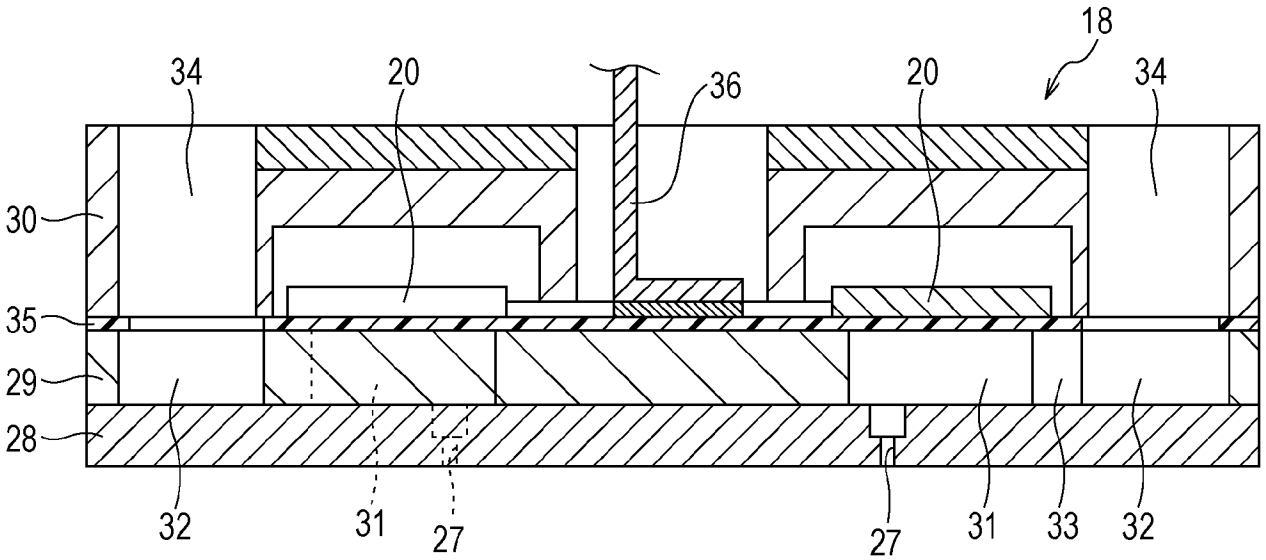

[Fig. 4A]
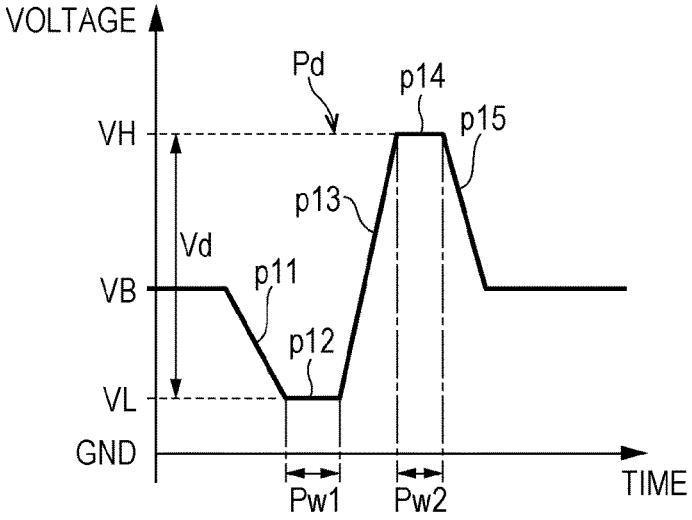
[Fig. 4B]
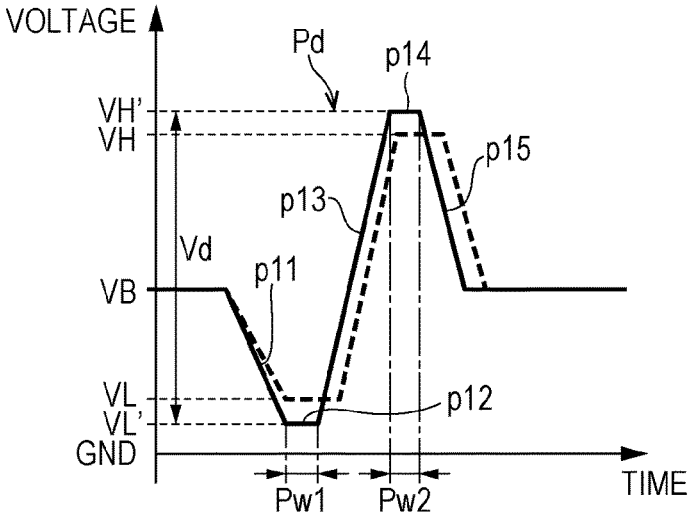
[Fig. 4C]
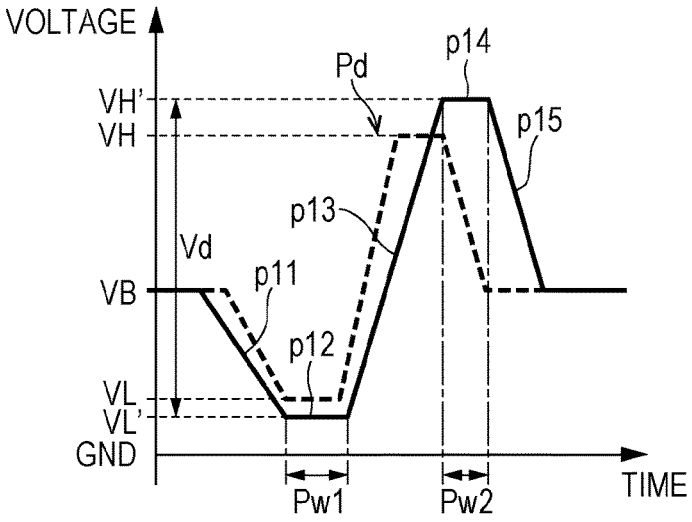

[Fig. 5]
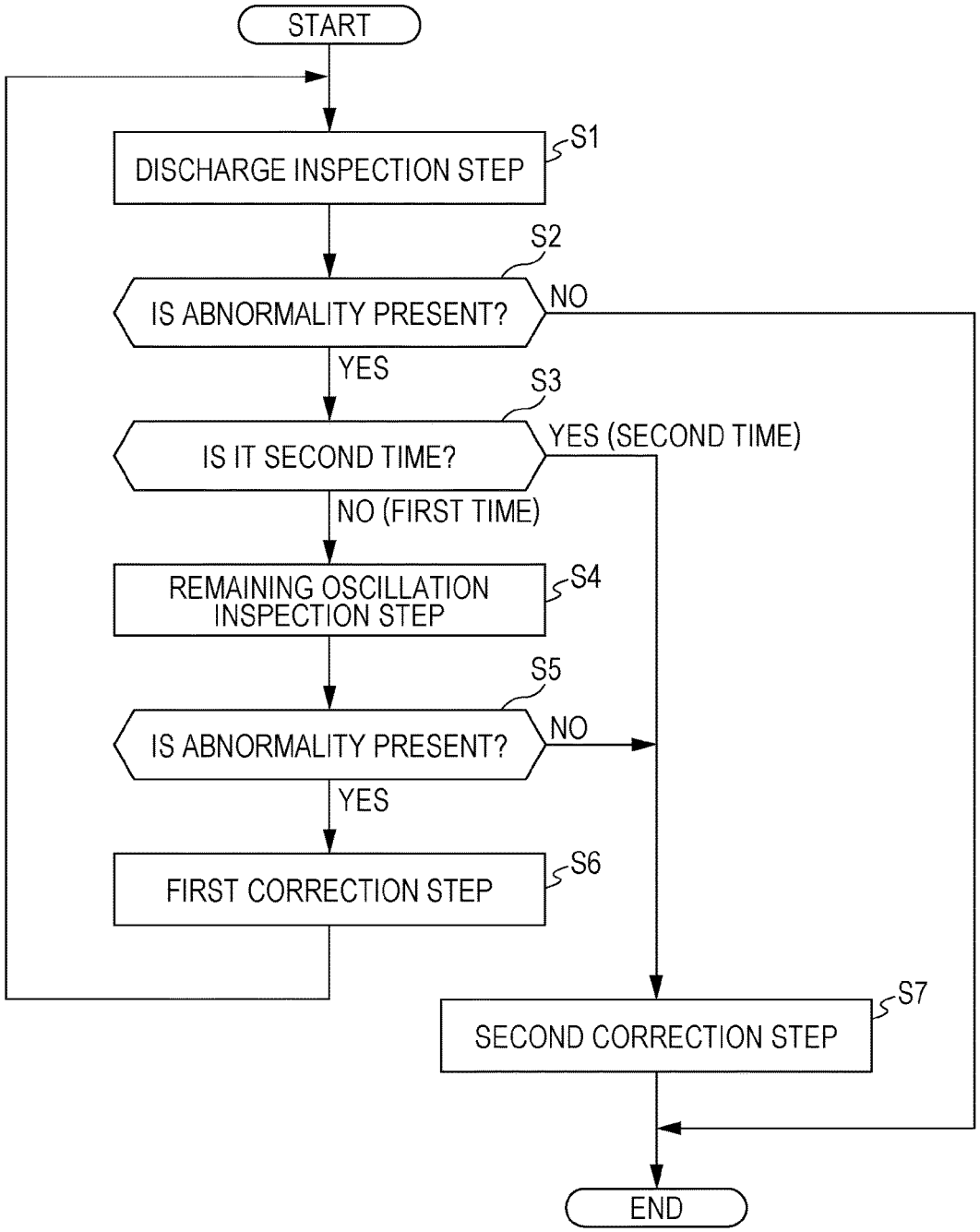

LIQUID DISCHARGING APPARATUS, CONTROL METHOD OF LIQUID DISCHARGING APPARATUS, DEVICE DRIVER, AND PRINTING SYSTEM

TECHNICAL FIELD

The present invention relates to a liquid discharging apparatus, such as an ink jet type recording device, a control method of a liquid discharging apparatus, a disk driver, and a printing system, and particularly to a liquid discharging apparatus which discharges liquid from a nozzle by driving an actuator and generating pressure oscillation in the liquid in a liquid flow path, a control method of a liquid discharging apparatus, a device driver, and a printing system.

BACKGROUND ART

A liquid discharging apparatus is a device which is provided with a liquid discharging head and discharges (ejects) various types of liquid from the liquid discharging head. An example of the liquid discharging apparatus includes an image recording device, such as an ink jet type printer or an ink jet type plotter, but in recent years, the liquid discharging apparatus has also been applied to various types of manufacturing devices by utilizing the advantageous characteristic that it is possible to make an extremely small amount of liquid accurately land at a predetermined position. For example, the liquid discharging apparatus is applied to a display manufacturing device which manufactures a color filter of a liquid crystal display or the like, an electrode forming device which forms an electrode, such as an organic electroluminescence (EL) display or a field emission display (FED), and a chip manufacturing device which manufactures a biochip (biochemical element). In addition, liquid type ink is discharged from a recording head for the image recording device, and the liquid having each color material, such as red (R), green (G), and blue (B) from a color material discharging head for the display manufacturing device. In addition, a liquid type electrode material is discharged from the electrode material discharging head for an electrode forming device, and a solution of the bioorganic matter is discharged from a bioorganic matter discharging head for the chip manufacturing device.

Here, in a printer which is one type of the above-described liquid discharging apparatus, there is a case where the ink (hereinafter, referred to as resin ink) containing thermoplastic resin particles is used (for example, refer to PTL 1). Since the resin ink forms a solid resin film when solidifying on a recording medium, it has an advantage in that its abrasion resistance and weather resistance are excellent compared to water-based ink. Meanwhile, there is a case where resin components contained in the ink gradually become attached to a flow path or a nozzle in the liquid discharging head, and accordingly, there is a concern that the discharging is adversely influenced.

CITATION LIST

Patent Literature

PTL 1: JP-A-2015-009519

SUMMARY OF INVENTION

Technical Problem

Various types of maintenance methods to respond to the above-described problem, and a correction method of a driving pulse which drives an actuator have also been suggested, but it is necessary that an attachment position of the resin components is changed in accordance with whether the attachment position is on an inner wall of the nozzle or the attachment position is on an inner wall of the liquid flow path further on an upstream side than the nozzle, and thus, it is difficult to specify the attachment position of the resin components in the related art.

In consideration of such a situation, it is an object of the present invention to provide a liquid discharging apparatus which can specify an attachment position in a configuration of discharging liquid containing resin, a control method of a liquid discharging apparatus, a device driver, and a printing system.

Solution to Problem (Solution 1)

In the present invention suggested for achieving the above-described object, there is provided a liquid discharging apparatus including: a liquid discharging head which includes a nozzle that discharges a liquid containing resin, a liquid flow path that individually communicates with the nozzle, and an actuator that generates pressure oscillation in the liquid in the liquid flow path, and which discharges the liquid from the nozzle by driving of the actuator; a first inspection mechanism which inspects a discharge abnormality of the nozzle; a second inspection mechanism which inspects oscillation of the liquid in the liquid flow path generated by the driving of the actuator; and a control circuit which performs processing of specifying either of attachment of the resin to the liquid flow path or attachment of the resin to the nozzle, in which the control circuit specifies an attachment position of the resin based on an inspection result of the discharge abnormality by the first inspection mechanism, and an inspection result of oscillation of the liquid in the liquid flow path by the second inspection mechanism.

According to the configuration of Solution 1, since the attachment position of the resin which is unlikely to be specified in the related art is specified based on the inspection result by the first inspection mechanism and the inspection result by the second inspection mechanism, it is possible to perform appropriate processing which corresponds to the attachment position of the resin.

(Solution 2)

In the liquid discharging apparatus according to Solution 1, it is preferable that the control circuit performs correction with respect to a driving pulse which drives the actuator in accordance with the specified attachment position of the resin.

According to the configuration of Solution 2, by appropriately correcting the driving pulse in accordance with the attachment position of the resin, even in a case where the attachment of the resin components contained in the liquid is generated, regardless of the attachment position, it is possible to make the amount or the flying speed of the liquid discharged from the nozzle close to a value which is the target of a design.

(Solution 3)

In the liquid discharging apparatus according to Solution 2, it is preferable that the control circuit performs inspection for specifying the attachment position of the resin, on a regular basis or based on an instruction of a user.

According to the configuration of the above-described Solution 3, by performing the inspection for specifying the attachment position of the resin on a regular basis or based on the instruction of the user, it is possible to respond to a change in situation that the attachment of the resin is further increased as time elapses, or the attached resin is peeled.

(Solution 4)

There is provided a control method of a liquid discharging apparatus including a liquid discharging head which includes a nozzle that discharges a liquid containing resin, a liquid flow path that individually communicates with the nozzle, and an actuator that generates pressure oscillation in the liquid flow path, and which discharges the liquid from the nozzle by driving of the actuator; a first inspection mechanism which inspects a discharge abnormality of the nozzle; and a second inspection mechanism which inspects oscillation of the liquid in the liquid flow path generated by the driving of the actuator, the method including: a first inspection step of inspecting the discharge abnormality of the nozzle by the first inspection mechanism; a second inspection step of inspecting the oscillation of the liquid in the liquid flow path by the second inspection mechanism when the discharge abnormality is detected in the first inspection step; a first correction step of performing correction which corresponds to the attachment of the resin inside the liquid flow path with respect to the driving pulse which drives the actuator when an abnormality is detected in the oscillation in the second inspection step; a third inspection step of re-inspecting the discharge abnormality of the nozzle after the first correction step; and a second correction step of performing the correction which corresponds to the attachment of the resin inside the nozzle with respect to the driving pulse when the abnormality is not detected in the oscillation in the second inspection step or when the discharge abnormality is detected in the third in the third inspection step.

According to the method of Solution 4, by specifying the attachment position of the resin components and appropriately correcting the driving pulse in accordance with the attachment position of the specified resin based on the inspection result by the first inspection mechanism and the inspection result by the second inspection mechanism, even when the attachment of the resin components contained in the liquid is generated, regardless of the attachment position, it is possible to make the amount or the flying speed of the liquid discharged from the nozzle close to a value which is the target of a design.

(Solution 5)

There is provided a device driver which can be executed in a host device connected to be communicable to a liquid discharging apparatus including a liquid discharging head which includes a nozzle that discharges a liquid containing resin, a liquid flow path that individually communicates with the nozzle, and an actuator that generates pressure oscillation in the liquid flow path, and which discharges the liquid from the nozzle by driving of the actuator; a first inspection mechanism which inspects a discharge abnormality of the nozzle; and a second inspection mechanism which inspects oscillation of the liquid in the liquid flow path generated by the driving of the actuator, the driver performing each step of the control method of a liquid discharging apparatus according to Solution 4 in the liquid discharging apparatus.

Furthermore, there is provided a printing system including: a host device which can execute the device driver according to Solution 5; and a liquid discharging apparatus connected to be communicable with the host device.

BRIEF DESCRIPTION OF DRAWINGS

FIG. 1 is a block diagram illustrating a configuration of a printing system.

FIG. 2 is a perspective view illustrating a configuration of the inside of a printer.

FIG. 3 is a sectional view illustrating a configuration of a recording head.

FIG. 4A is a waveform view illustrating selection of a driving pulse.

FIG. 4B is a waveform view illustrating selection of a driving pulse.

FIG. 4C is a waveform view illustrating selection of a driving pulse.

FIG. 5 is a flowchart illustrating processing of the printing system.

DESCRIPTION OF EMBODIMENT

Hereinafter, an embodiment for realizing the present invention will be described with reference to the attached drawings. In addition, in the embodiment which will be described hereinafter, the present invention is restricted in various ways to an appropriate specific example, but the range of the present invention is not limited to the aspects insofar as there is no particular remark on the restriction of the present invention otherwise stated.

FIG. 1 is a block diagram illustrating a printing system according to the present invention.

In the printing system, a host device, such as a host computer 1 or the like, and an ink jet printer (hereinafter, simply referred to as a printer) 3 are connected so as to be communicable in a wired or wireless manner. The host computer 1 includes a CPU 5, a memory 6, an input/output interface (I/O) 7, and an auxiliary storage device 8, and the members are connected to each other via an inner bus. The auxiliary storage device 8 is configured of, for example, a hard disk drive, and a device driver or the like, such as an operation program, various types of application programs, and a printer driver 9, is stored in the storage device 8. In addition, the CPU 5 performs various types of processing, such as execution of the application program or the printer driver 9, according to the operation system stored in the auxiliary storage device 8. The input/output interface 7 is formed of an interface, such as a USB or an IEEE 1394, is connected to the input/output interface 7 of the printer 3, and outputs a request of recording processing or the like or data or the like related to printing, which is created by the printer driver 9, to the printer 3. The printer driver 9 is a program for performing processing of converting image data (image data or text data) prepared by the application program into dot pattern data (which is also referred to as raster data) used in the printer 3, or various types of printing settings. In addition, the processing of the printer driver 9 will be described later.

The printer 3 in the embodiment includes a CPU 11 (which corresponds to a control circuit in the present invention), a memory 12, an input/output interface 13, a driving signal generation circuit 14, a paper feeding mechanism 16, a carriage moving mechanism 17, a discharge inspection mechanism 40, an oscillation inspection circuit 41, and a recording head 18. The discharge inspection mechanism 40 (which corresponds to a first inspection mechanism in the present invention) is a mechanism which inspects whether or not the ink is normally discharged from a nozzle 27 (refer to FIG. 3 or the like) of the recording head 18. The CPU 11 also functions as a part of the first inspection mechanism, and inspects whether or not discharge abnormality in the nozzle 27 is present based on a detected signal from the discharge inspection mechanism 40. In addition, the oscillation inspection circuit 41 (which corresponds to a second inspection mechanism in the present invention) is configured so as to output a reverse electromotive force signal of a piezoelectric element 20 to the CPU 11 as the detected signal based on a pressure oscillation (residual oscillation) generated in ink inside a pressure chamber when the piezoelectric element 20 is driven by a driving pulse Pd (refer to FIG. 4). The CPU 11 also functions as a part of the second inspection mechanism, and inspects the oscillation of the ink inside the pressure chamber by using the piezoelectric element 20 as an oscillation sensor. In addition, a discharge inspection step by the discharge inspection mechanism 40, and an oscillation inspection step by the oscillation inspection circuit 41 will be described in detail later.

The input/output interface 13 receives and sends various types of data, for example, receives a request of recording processing or the like or data related to printing from the host computer 1 side which is one type of a host device, or outputs information regarding a state of the printer 3 to the host computer 1 side. The CPU 11 is an arithmetic processing device for performing the control of the entire printer. The memory 12 is an element which stores a program of the CPU 11 or data used in various types of control, and examples of which include a ROM, a RAM, and an NVRAM (nonvolatile random access memory). The CPU 11 controls each unit according to the program stored in the memory 12. In addition, the CPU 11 in the embodiment sends dot pattern data from the host device side to the control device 19 of the recording head 18. The driving signal generation circuit 14 (driving pulse generation circuit) generates an analog signal, amplifies the signal, and generates a driving signal illustrated in FIG. 4, based on waveform data related to a waveform of the driving signal. The control device 19 performs control to selectively apply the driving pulse in the driving signal generated by the driving signal generation circuit 14 with respect to each piezoelectric element 20. In addition, regarding a connection type between the printer 3 and the host device, not being limited to the example, various methods can be employed.

In the printer 3 in the embodiment, the recording head 18 is attached to a bottom surface side of a carriage 23 on which an ink cartridge 22 is loaded. In addition, the carriage 23 is configured to be able to be reciprocated along a guide rod 24 by the carriage moving mechanism 17. In other words, the printer 3 sequentially transports a recording medium S, such as recording paper, by the paper feeding mechanism 16, discharges the ink from the nozzle 27 (refer to FIG. 3 or the like) of the recording head 18 while relatively moving the recording head 18 in a width direction (main scanning direction) of the recording medium S with respect to the recording medium, and records an image or the like as the ink lands on the recording medium S. In addition, it is possible to employ a configuration in which the ink cartridge 22 is disposed on a main body side of the printer, and the ink of the ink cartridge 22 is fed to the recording head 18 side through a supply tube.

One end portion (right hand side in FIG. 2) in a scanning direction of the carriage 23 is a home position, and a capping mechanism 25 which can seal a nozzle surface of the recording head 18 is installed below the home position. The capping mechanism 25 is formed of a cap 26 made of a tray-shaped elastic material in which an upper surface side is open, and a pump which is not illustrated and makes a space of the inside of the cap 26 have negative pressure in a state where the nozzle surface is sealed. In addition, the capping mechanism 25 is configured to be capable of being raised and lowered by a raising/lowering mechanism which is not illustrated, and can switch a sealed state where the cap 26 seals the nozzle surface of the recording head 18 and a relief state where the cap 26 is separated from the nozzle surface. In a maintenance operation (suction cleaning operation) which is a process of removing the thickened ink or bubbles from a flow path inside the recording head 18 and alleviating clogging of the nozzle 27, by operating the pump in the capped state and making the space of the inside of the cap 26 have negative pressure, the ink or the bubbles are forcibly ejected to the inside of the cap 26 from the nozzle. The waste ink ejected to the cap 26 is ejected to a waste ink tank which is not illustrated.

FIG. 3 is a sectional view of main parts illustrating a structure of the inside of the recording head 18.

The recording head 18 in the embodiment is schematically formed of a nozzle plate 28, a flow path substrate 29, and the piezoelectric element 20, and is attached to a case 30 in a state where the members are stacked. The nozzle plate 28 is a member which is formed of a silicon single crystal substrate on which the plurality of nozzles 27 are established in a row along the same direction at a pitch which corresponds to a dot formation density. In the embodiment, the nozzle row (one type of nozzle group) configured of the plurality of nozzles 27 installed in parallel is formed of, for example, 360 nozzles 27. In addition, a surface on a side where the ink of the nozzle plate 28 is discharged corresponds to a nozzle surface.

On the flow path substrates 29, a plurality of hollow portions which become pressure chambers 31 are formed in accordance with each nozzle 27. On the outside of the row of the pressure chambers 31 on the flow path substrate 29, a common liquid chamber 32 which is a hollow portion common to each pressure chamber 31 is formed. The common liquid chamber 32 communicates with each pressure chamber 31 via an ink supply port 33. In addition, the pressure chambers 31 which separately communicate with the nozzles 27 and the ink supply port 33 correspond to a liquid flow path in the present invention (hereinafter, appropriately, referred to as a separate flow path). In addition, the ink from the ink cartridge side is introduced through an ink introduction path 34 of the case 30 to the common liquid chamber 32. On an upper surface which is a side opposite to the nozzle plate 28 side of the flow path substrate 29, the piezoelectric element 20 (one type of actuator) is formed via an elastic film 35. The piezoelectric element 20 is formed by sequentially stacking a metal-made lower electrode film, a piezoelectric layer made of lead zirconate titanate, and a metal upper electrode film (none of these is illustrated). The piezoelectric element 20 is a so-called bending mode piezoelectric element, and is formed so as to cover the upper portion of the pressure chamber 31. The piezoelectric element 20 is deformed in response to the driving signal (driving pulse (refer to FIG. 4)) being applied through a wiring member 36. Accordingly, pressure oscillation is generated in the ink inside the pressure chamber 31 corresponding to the piezoelectric element 20, and the ink is discharged from the nozzle 27 by controlling the pressure oscillation of the ink.

FIG. 4 is a waveform view illustrating an example of the driving pulse generated by the driving signal generation circuit 14. In addition, FIG. 4A illustrates a waveform view of a basic pulse before correction, FIG. 4B is a waveform view illustrating a first correction step with respect to the basic pulse, and FIG. 4C is a waveform view illustrating a second correction step with respect to the basic pulse. In addition, the correction of the driving pulse will be described later. In the embodiment, the driving pulse Pd in the embodiment is formed of an expansion element p11, an expansion hold element p12, a contraction element p13, a contraction hold element p14, and a recovery element p15. The expansion element p11 is a waveform element in which a potential changes from a reference potential VB to an expansion potential VL, on a ground potential GND side. The expansion hold element p12 is a waveform element which maintains the expansion potential VL that is a final end potential of the expansion element p11 for a certain period of time. The contraction element p13 is a waveform element in which the potential changes to a contraction potential VH at a relatively steep gradient to a positive side exceeding the reference potential VB from the expansion potential VL. The contraction hold element p14 is a waveform element which maintains the contraction potential VH for a certain period of time. The recovery element p15 is a waveform element which recovers the potential from the contraction potential VH to the reference potential VB. In addition, the exemplified driving pulse Pd can also be used as the driving pulse for the inspection to be described later.

When the driving pulse Pd which is formed as described above is applied to the piezoelectric element 20, first, the piezoelectric element 20 bends toward the outside (side to which the piezoelectric element 20 is separated from the nozzle plate 28) of the pressure chamber 31 by the expansion element p11, and according to this, the pressure chamber 31 expands to an expansion volume which corresponds to the expansion potential VL from a reference volume which corresponds to the reference potential VB. By the expansion, meniscus of the ink in the nozzle 27 is drawn into the pressure chamber 31 side from a standby position (position of the meniscus when the pressure chamber 31 is maintained to have the reference volume) along an axial direction of the nozzle 27. In addition, the expanded state of the pressure chamber 31 is maintained by the expansion hold element p12 for a certain period of time. After being held by the expansion hold element p12, the piezoelectric element 20 is bent to the inside (side which is close to the nozzle plate 28) of the pressure chamber 31 by the contraction element p13. According to this, the pressure chamber 31 is rapidly contracted to the contraction volume which corresponds to the contraction potential VH from the expansion volume. Accordingly, the ink inside the pressure chamber 31 is pressurized, and the meniscus drawn into the pressure chamber 31 side is pushed out passing the standby position along the axial direction of the nozzle 27 to the discharge side opposite to the pressure chamber 31 side. Accordingly, ink droplets are discharged from the nozzle 27. The contraction state of the pressure chamber 31 is maintained across a supply period of the contraction hold element p14, and during the period, the pressure of the ink in the pressure chamber 31 which is reduced by the discharge of the ink is raised again by the pressure oscillation. The time of the contraction hold element p14 is adjusted so that the recovery element p15 is applied to the piezoelectric element 20 in accordance with the raising timing. As the recovery element p15 is applied, the piezoelectric element 20 returns to a normal position which corresponds to the reference potential VB. According to this, the pressure chamber 31 is expansion-recovered to a normal volume, and the pressure oscillation (remaining oscillation) of the ink in the pressure chamber 31 is absorbed.

Regarding the driving pulse Pd (basic pulse), a driving voltage Vd (a potential difference between the expansion potential VL and the contraction potential VH) is set so that the amount of ink discharged from the nozzle 27 becomes a constant value, that is a value which is the target of a design. In addition, a time period (time of expansion hold element p12) Pw1 from a final end of the expansion element p11 to a starting end of the contraction element p13, and a time period (time of the contraction hold element p14) Pw2 from a final end of the contraction element p13 to a starting end of the recovery element p15, are determined based on the Helmholtz period (intrinsic oscillation period of the ink) Tc of the pressure oscillation generated in the ink in the pressure chamber 31. The intrinsic oscillation period Tc can be generally expressed by the following Formula (1).

$$Tc=2\pi\sqrt{[(Mn+Ms)/(Mn\times Ms\times(Cc+Ci))]} \quad (1)$$

In Formula (1), Mn is inertance (mass of the ink per unit sectional area) of the nozzle 27, Ms is inertance of the ink supply port 33, Cc is compliance (illustrating a level of a volume change per unit pressure, and softness) of the pressure chamber 31, and Ci is compliance of the ink (Ci=Volume V/[density ρ×speed of sound $c^2$]). Accordingly, it is possible to appropriately perform the discharge of the ink in accordance with the pressure oscillation generated in the ink in the pressure chamber 31, or the control of the remaining oscillation after the discharge.

Meanwhile, the printer 3 in the embodiment is configured to discharge the ink (hereinafter, referred to as resin ink) containing the thermoplastic resin particles by the recording head 18. For this reason, there is a problem that the resin components contained in the ink become attached to an inner wall of the nozzle 27 or an inner wall of the ink flow path, such as the pressure chamber 31, as time elapses. When the resin components are attached in the ink flow path or the like, since the dimensions or the rigidity of the flow path changes, the discharge characteristics of the nozzle 27 are influenced. Specifically, in order to reduce the internal diameter of the nozzle 27 when the resin is attached in the nozzle 27, for example, the weight of the discharged ink droplets is reduced compared with that before being attached, and the flying speed of the ink droplets is increased. In addition, since the inertance in the nozzle 27 decreases, there is a tendency for the above-described intrinsic oscillation period Tc to increase. In addition, inertance M is approximately expressed by the following Formula (2) when the density of the ink is p, the sectional area in a direction orthogonal to a direction of ink flow of the flow path is S, and the length of the flow path is L.

$$M=(\rho\times L)/S \quad (2)$$

In addition, when the resin is attached to separate flow paths of each nozzle 27, that is, in the pressure chamber 31 or the ink supply port 33, there is a tendency that the above-described intrinsic oscillation period Tc decreases. Furthermore, when the resin is attached to the elastic film 35 (diaphragm) which divides the pressure chamber 31, since it becomes unlikely that the elastic film 35 moves when the piezoelectric element 20 is driven and the displacement becomes small, the weight of the ink droplets discharged from the nozzle 27 decreases, and the above-described intrinsic oscillation period Tc decreases. In this manner, the tendency of the change in the discharge characteristics of the ink varies in accordance with the position at which the resin is attached. Here, in the printing system according to the present invention, by using the inspection result by the discharge inspection mechanism 40 and the inspection result by the oscillation inspection circuit 41, the attachment position of the resin in the recording head 18 is specified, and according to this, appropriate correction is performed.

FIG. 5 is a flowchart illustrating a flow of control in the printing system according to the present invention. In the embodiment, at every constant interval, or when there is an instruction from a user via the printer driver 9, inspection of the presence or absence of the attachment of the resin, specification of the attachment position, and correction of the driving pulse in accordance with the attachment position, are performed. First, the recording head 18 is positioned above the capping mechanism 25 of the home position, and a discharge inspection step (which corresponds to a first inspection step in the present invention) is performed (step S1). The discharge inspection mechanism 40 inspects the flying speed or the weight of the ink when the ink is discharged from the nozzle 27 of the recording head 18 with respect to the cap 26 as a liquid receiving portion provided in the capping mechanism 25 of the home position. Inside the cap 26 of the capping mechanism 25, an electrode member which is not illustrated is installed, and for example, an electric field is imparted so that the electrode member becomes a positive electrode, and the nozzle plate 28 of the recording head 18 becomes a negative electrode. In addition, the discharge inspection mechanism 40 inspects a change in voltage from the discharge of the ink from the nozzle 27 to the landing of the ink in the cap 26, and outputs a signal to the CPU 11 as the detected signal. In addition, a more specific inspection method is disclosed in JP-A-2009-279765. In addition, a method for measuring the weight of the discharged ink droplets, a method for optically inspecting the flying speed of the ink droplets discharged from the nozzle 27, and other various known methods can be employed. In any case, as the discharge inspection mechanism 40, a configuration in which it is possible to inspect whether or not a discharge abnormality is generated regardless of whether the attachment position of the resin components is in the nozzle 27 or in the separate flow path, such as the pressure chamber 31.

Next, the CPU 11 determines whether or not a discharge abnormality is present, based on the detected signal from the discharge inspection mechanism 40 (step S2). In other words, discharge abnormality, such as deviation of the amount (mass and volume) or the flying speed of the ink discharged from the nozzle 27 from a target value, or failure of ejection of the ink from the nozzle 27, is generated, the value of the detected signal from the discharge inspection mechanism 40 changes from a normal value. The CPU 11 determines that the discharge abnormality is generated regarding the nozzle 27 when the value of the detected signal changes from the normal value. Here, when it is determined that discharge abnormality is not present in step S2 (NO), since the attachment of the resin components is not even generated in either of the inside of the nozzle 27 and the inside of the separate flow path, such as the pressure chamber 31, that communicates with the inside of the nozzle 27, the processing is finished. Meanwhile, when it is determined that a discharge abnormality is present in step S2 (YES), it is ascertained that the attachment of the resin is generated in at least one of the inside of the nozzle 27 and the separate flow path, such as the pressure chamber 31, that communicates with the inside of the nozzle 27. In addition, it is determined whether or not the discharge inspection step is performed for the second time in the current series of processing (step S3), and when it is determined that the discharge inspection step is performed for the first time (NO), then, a remaining oscillation inspection step (step S4) is performed. In addition, a case where the discharge inspection step is performed for the second time will be described later.

In the remaining oscillation inspection step (which corresponds to a second inspection step in the present invention), as the driving pulse Pd is applied to the piezoelectric element 20 that corresponds to the nozzle 27 to be an inspection target, and the piezoelectric element 20 is driven, the pressure oscillation is generated in the corresponding pressure chamber 31. According to attenuation oscillation (remaining oscillation) of the pressure oscillation, an operation surface (elastic film 35) of the pressure chamber 31 and the piezoelectric element 20 also oscillates, and a reverse electromotive force is generated by the piezoelectric element 20 due to the oscillation. The oscillation inspection circuit 41 detects this, and outputs the reverse electromotive force signal to the CPU 11. Specifically, the method is disclosed in JP-A-2014-091295. The CPU 11 determines whether or not an abnormality is present in the remaining oscillation (whether or not an amplitude component or a frequency component of the remaining oscillation has deviated from a reference value) based on the reverse electromotive signal from the oscillation inspection circuit 41 (step S5). Here, in the remaining oscillation detection step, when the attachment of the resin to the inside of the separate flow path, such as the pressure chamber 31, occurs, it is possible to detect the attachment as a change in the amplitude component or a change in the frequency component of the remaining oscillation. Meanwhile, it is not possible to detect the attachment of the resin inside the nozzle 27, since it is difficult to express the attachment as the change of each component of the remaining oscillation. For this reason, when it is determined that an abnormality is present in the remaining oscillation in step S5 (YES), it is determined that the attachment of the resin is generated at least on the inside of the separate flow path. In this case, in step S6, a first correction step according to the attachment inside the separate flow path is performed.

Contents of Claims 1, 2, and 4 to 6

As described above, when the resin is attached to the inside of the separate flow path, such as the pressure chamber 31, the intrinsic oscillation period Tc tends to decrease. When the intrinsic oscillation period Tc becomes short, a discharging timing is shifted by the contraction element p13 in the driving pulse Pd, and a controlling timing is shifted by the recovery element p15. In addition, when the resin is attached to the elastic film 35 which divides the pressure chamber 31, the weight of the ink droplets discharged from the nozzle 27 is reduced. The attachment position of the resin component in the pressure chamber 31 can be ascertained based on the reverse electromotive force signal from the oscillation inspection circuit 41. For example, when only the frequency component of the reverse electromotive force signal is changed from the reference value, it is ascertained that the attachment of the resin occurs at a part other than the elastic film 35 in the pressure chamber 31. In addition, for example, when both the frequency component and the amplitude component of the reverse electromotive force signal have changed from the reference value, it is considered that the attachment occurs at the elastic film 35. In the first correction step, as illustrated in FIG. 4B, the time period Pw1 of the expansion hold element p12 in the driving pulse Pd and the time period Pw2 of the contraction hold element p14 are changed by an amount corresponding to the change in the intrinsic oscillation period Tc. In other words, when the intrinsic oscillation period Tc is shorter than the reference value, the Pw1 and Pw2 are corrected so as to be shorter than in the case of the reference pulse by a corresponding amount, and when the intrinsic oscillation period Tc is longer than the reference value, the Pw1 and Pw2 are corrected so as to be longer than in the case of the reference pulse by a corresponding amount. Accordingly, the discharging timing by the contraction element p13 or the controlling timing by the recovery element p15 is appropriately adjusted. In addition, when the amplitude component of the remaining oscillation is changed, the driving voltage Vd of the driving pulse Pd is increased by a corresponding amount. In other words, when the amplitude component is smaller than the reference value, the driving voltage Vd becomes higher, than in the case of the reference pulse by a corresponding amount. Accordingly, it is possible to make the amount of the ink droplets discharged from the nozzle 27 close to the target value. When the first correction step is finished, consequently, the process returns to step S1, and the discharge inspection step is performed for the second time (this will be described later).

In step S5, when it is determined that an abnormality is not present in the remaining oscillation (NO), it is ascertained that the discharge abnormality occurred due to the attachment of the resin to the inside of the nozzle 27. In other words, it is specified that the attachment position is inside the nozzle 27. In this case, in step S7, the second correction step is performed in accordance with the attachment inside the nozzle 27.

As described above, when the resin is attached to the inside of the nozzle 27, the weight of the discharged ink droplets is reduced, or the flying speed of the ink droplets increases. For this reason, in the second correction step, as illustrated in FIG. 4C, the driving voltage Vd of the driving pulse Pd becomes higher than in the case of the reference pulse only as much as the amplitude component of the remaining oscillation is changed. Accordingly, it is possible to make the amount of the ink droplets discharged from the nozzle 27 close to the target amount. In addition, in accordance with the increase in the flying speed of the ink droplets, an inclination (gradient of the potential change) of a potential change element in the driving pulse Pd, that is, the expansion element p11 and the contraction element p13 is set to be more gradual than in the case of the reference pulse. Accordingly, it is possible to make the flying speed of the ink droplets close to the target value. After the second correction step, a series of processing operations is finished.

Meanwhile, after the first correction step, the discharge inspection step (which corresponds to a third inspection step in the present invention) is performed for a second time in step S1, because a possibility that the attachment of the resin component is generated not only in the separate flow path, but also inside the nozzle 27, still remains. As a result of the second discharge inspection step, when it is determined that the discharge abnormality is not detected in step S2 (NO), it is ascertained that the attachment of the resin component is present only in the separate flow path, and the processing is finished. Meanwhile, as a result of the second discharge inspection step, when it is determined that the discharge abnormality is detected in step S2 (YES), it is ascertained that the attachment of the resin component is generated not only in the separate flow path but also inside the nozzle 27. In this case, it is determined that the discharge inspection step is performed for the second time in step S3 (YES), and the second correction step is performed in accordance with the attachment inside the nozzle 27 in step S7. In addition, the above-described processing can be performed for every nozzle 27 or for every nozzle row.

Above, since the attachment position of the resin component which was unlikely to be specified in the related art, is specified based on the result of the discharge inspection step by the discharge inspection mechanism 40 and the result of the remaining oscillation inspection step by the oscillation inspection circuit 41, it is possible to perform appropriate processing in accordance with the attachment position of the resin. Specifically, it is possible to appropriately correct the driving pulse Pd in accordance with the attachment position of the resin. Accordingly, regardless of the attachment position even in a case where the attachment of the resin component contained in the ink is generated, it is possible to make the amount or the flying speed of the ink droplets discharged from the nozzle 27 close to the value which is the target of a design.

The processing of inspecting the presence or the absence of the attachment of the resin, specifying the attachment position, and the correcting the driving pulse in accordance with the attachment position, is performed on a regular basis or based on the instruction by the user via the printer driver 9. Since there is a possibility that the attachment of the resin is further increased as time elapses or the attached resin is peeled, it is possible to react to the change in the situation by performing the above-described processing on a regular basis.

In addition, the correction method in the first correction step or the second correction step is not limited to the example, if it is possible to recover the change in the discharge characteristics generated by the attachment of the resin, various known methods can be employed.

In addition, regarding the driving pulse Pd, not being limited to the example in FIG. 4, various known driving pulses can be employed.

In addition, in the above-described embodiment, the so-called bending oscillation type piezoelectric element 20 is described as an example of an actuator, but the present invention is not limited thereto, and can also be employed in a case where various types of actuators, such as a so-called longitudinal oscillation type piezoelectric element, a heating element, and an electrostatic actuator which changes the volume of the pressure chamber by using an electrostatic force.

In addition, if the liquid discharging apparatus discharges the liquid containing the component which is likely to be attached in the flow path, the present invention is not limited to the printer 3, and can also be employed in various ink jet type recording apparatuses, such as a plotter, a facsimile machine, or a copy machine, or a liquid droplet discharging apparatus, such as a printing equipment which performs printing by making the ink from a liquid discharging head land on fabric (material to be printed) which is one type of a landing target.

REFERENCE SIGNS LIST

1 Host computer
3 Printer
9 Printer driver
11 CPU
14 Driving signal generation circuit
18 Recording head
20 Piezoelectric element
27 Nozzle
31 Pressure chamber
33 Ink supply port
40 Discharge inspection mechanism
41 Oscillation inspection circuit

The invention claimed is:

1. A liquid discharging apparatus comprising:

a liquid discharging head which includes a nozzle that discharges a liquid containing resin, a liquid flow path that individually communicates with the nozzle, and an actuator that generates pressure oscillation in the liquid in the liquid flow path, and which discharges the liquid from the nozzle by driving of the actuator;

a first inspection mechanism which inspects a discharge abnormality of the nozzle;

a second inspection mechanism which inspects oscillation of the liquid in the liquid flow path generated by the driving of the actuator; and a control circuit which performs processing of specifying any of attachment of the resin to the liquid flow path or attachment of the resin to the nozzle, wherein the control circuit specifies an attachment position of the resin based on an inspection result of the discharge abnormality by the first inspection mechanism, and an inspection result of oscillation of the liquid in the liquid flow path by the second inspection mechanism.

2. The liquid discharging apparatus according to claim 1, wherein the control circuit performs correction with respect to a driving pulse which drives the actuator in accordance with the attachment position of the specified resin.

3. The liquid discharging apparatus according to claim 2, wherein the control circuit performs inspection for specifying the attachment position of the resin, on a regular basis or based on an instruction of a user.

4. The liquid discharging apparatus according to claim 1, wherein the control circuit performs inspection for specifying the attachment position of the resin, on a regular basis or based on an instruction of a user.

5. A control method of a liquid discharging apparatus including a liquid discharging head which includes a nozzle that discharges a liquid containing resin, a liquid flow path that individually communicates with the nozzle, and an actuator that generates pressure oscillation in the liquid flow path, and which discharges the liquid from the nozzle by driving of the actuator; a first inspection mechanism which inspects a discharge abnormality of the nozzle; and a second inspection mechanism which inspects oscillation of the liquid in the liquid flow path generated by the driving of the actuator, the method comprising:

a first inspection step of inspecting the discharge abnormality of the nozzle by the first inspection mechanism;

a second inspection step of inspecting the oscillation of the liquid inside the liquid flow path by the second inspection mechanism when the discharge abnormality is detected in the first inspection step;

a first correction step of performing correction which corresponds to the attachment of the resin inside the liquid flow path with respect to the driving pulse which drives the actuator when an abnormality is detected in the oscillation in the second inspection step;

a third inspection step of re-inspecting the discharge abnormality of the nozzle after the first correction step; and a second correction step of performing the correction which corresponds to the attachment of the resin inside the nozzle with respect to the driving pulse when the abnormality is not detected in the oscillation in the second inspection step or when the abnormality is detected in the oscillation in the third inspection step.

6. A device driver which can be executed in a host device connected to be communicable to a liquid discharging apparatus including a liquid discharging head which includes a nozzle that discharges a liquid containing resin, a liquid flow path that individually communicates with the nozzle, and an actuator that generates pressure oscillation in the liquid flow path, and which discharges the liquid from the nozzle by driving of the actuator; a first inspection mechanism which inspects a discharge abnormality of the nozzle; and a second inspection mechanism which inspects oscillation of the liquid in the liquid flow path generated by the driving of the actuator, the driver performing each step of the control method of a liquid discharging apparatus according to claim 4 in the liquid discharging apparatus.

7. A printing system comprising:

a host device which can execute the device driver according to claim 6; and a liquid discharging apparatus connected to be communicable with the host device.

* * * * *